US006321402B1

(12) United States Patent
Ming-Chung

(10) Patent No.: US 6,321,402 B1
(45) Date of Patent: Nov. 27, 2001

(54) DISPOSABLE PULP-MOLDED PILLOW

(76) Inventor: Tsai Ming-Chung, 3F, No. 38, Lane 10, Lin-Kou St., Taipei (TW)

( * ) Notice: Subject to any disclaimer, the term of this patent is extended or adjusted under 35 U.S.C. 154(b) by 0 days.

(21) Appl. No.: 09/583,996

(22) Filed: May 30, 2000

(51) Int. Cl.[7] ..... A47G 9/00

(52) U.S. Cl. ..... 5/636; 5/643; 5/645; 5/639; 5/944; 5/951

(58) Field of Search ..... 5/636, 639, 643, 5/487, 490, 924, 944, 951, 640, 642, 645

(56) References Cited

U.S. PATENT DOCUMENTS

| | | | | |
|---|---|---|---|---|
| 2,412,953 | * | 12/1946 | Auerbach | 5/951 X |
| 2,552,476 | * | 5/1951 | Barton | 5/951 X |
| 2,667,915 | * | 2/1954 | Pfeffer et al. | 5/951 X |
| 2,880,428 | * | 4/1959 | Forsland | 5/636 |
| 2,940,088 | * | 6/1960 | Boos | 5/636 |
| 3,319,272 | * | 5/1967 | Eller | 5/639 |
| 3,829,917 | * | 8/1974 | De Laittre et al. | 5/636 |
| 4,210,134 | * | 7/1980 | Okazaki et al. | 5/636 X |
| 4,218,792 | * | 8/1980 | Kogan | 5/636 |
| 4,320,543 | * | 3/1982 | Dixon | 5/636 X |
| 4,726,087 | * | 2/1988 | Schaefer et al. | 5/944 X |
| 4,748,702 | * | 6/1988 | Sandler | 5/643 X |
| 4,821,355 | * | 4/1989 | Burkhardt | 5/636 |
| 4,832,007 | * | 5/1989 | Davis, Jr. et al. | 5/636 X |
| 4,899,405 | * | 2/1990 | Rothbard | 5/636 |
| 4,916,765 | * | 4/1990 | Castronovo, Jr. | 5/636 X |
| 4,918,774 | * | 4/1990 | Popitz | 5/636 X |
| 5,014,377 | * | 5/1991 | Dixon | 5/636 |
| 5,088,141 | * | 2/1992 | Meyer et al. | 5/636 X |
| 5,103,517 | * | 4/1992 | Krouskop | 5/702 |
| 5,123,132 | * | 6/1992 | Dixon | 5/636 |
| 5,163,194 | * | 11/1992 | Dixon | 5/639 X |
| 5,168,590 | * | 12/1992 | O'Sullivan | 5/636 X |
| 5,363,524 | * | 11/1994 | Lang | 5/645 X |
| 5,533,218 | * | 7/1996 | Fahy | 5/636 |
| 5,644,809 | * | 7/1997 | Olson | 5/636 |
| 5,682,633 | * | 11/1997 | Davis | 5/636 |
| 5,708,998 | * | 1/1998 | Torbik | 5/645 X |
| 5,724,687 | * | 3/1998 | Kim | 5/944 |
| 5,743,271 | * | 4/1998 | Royo-Salvador | 128/845 |
| 5,771,514 | * | 6/1998 | Wilhoit | 5/644 |
| 5,809,594 | * | 9/1998 | Isogai | 5/643 |
| 5,819,743 | * | 10/1998 | McMillin et al. | 5/636 X |
| 5,911,656 | * | 6/1999 | Futagami | 5/636 X |
| 5,926,879 | * | 7/1999 | Davis | 5/636 |
| 6,003,177 | * | 12/1999 | Ferris | 5/636 |
| 6,047,425 | * | 4/2000 | Khazaal | 5/645 X |

FOREIGN PATENT DOCUMENTS

| | | | | |
|---|---|---|---|---|
| 2915047-A | * | 10/1980 | (DE) | 5/636 |
| 8101524 | * | 11/1981 | (DE) | 5/636 |
| 2263740-A | * | 10/1975 | (FR) | 5/640 |

* cited by examiner

*Primary Examiner*—Robert G. Santos
(74) *Attorney, Agent, or Firm*—W. Wayne Liauh

(57) ABSTRACT

A disposable pillow made of recyclable and environmentally friend pulp through vacuum molding is provided. The pillow includes an open-bottomed hollow outer body and preferably an inner support having a plurality of upright ridge portions. The outer body has a top surface within which a smoothly curved recess is formed for comfortably supporting a patient's head. The inner support is adapted to be positioned in and below the outer body with upper ends of the ridge portions fitly contacting with and therefore firmly supporting an underside of the top surface of the outer body, preventing the top surface from downward collapsed when a patient's head is supported thereat.

4 Claims, 3 Drawing Sheets

DISPOSABLE PULP-MOLDED PILLOW

BACKGROUND OF THE INVENTION

The present invention relates to a disposable pillow, and more particularly to a disposable pillow made of pulp through vacuum molding for use by a person, especially a patient, for a short period of time in hospital to avoid possible infection by contact with survived bacteria on the hospital-supplied pillow.

While the biochemical industry makes rapid and high developments of many different medicines, there are more and more types of bacteria developed strong ability to resist such medicines and extremely severe environment. That is why there are so many diseases that are still beyond our medical control.

A hospital is, on the one hand, a place at where patients are treated and, on the other hand, a public place being most dangerously subjected to harmful bacteria. There are patients who are infected with other disease while they are in hospital to accept treatment for a previously infected disease. And this occurs in part due to the patient's weak physical conditions that subject the patient to infection with bacteria existing in the hospital.

Diseases propagate through many ways. A patient might be infected by air, direct contact, blood, secretion or food. And a patient in hospital would inevitably use bedclothes and pillows supplied by the hospital. These bedclothes and pillows are not absolutely bacteria-free even though they have been properly sterilized. Taking the pillow as an example, it is an item closest to the patient's mouth and nose and is therefore a most possible way by which the patient's digestive and respiratory systems are infected. It is therefore most preferable that a patient prepares at least the pillow for his or her own use in the hospital.

A pillow having been used by a patient in the hospital is naturally not suitable for bringing home after the patient is out of hospital. Such pillow should preferably be properly disposed in the hospital to avoid unnecessary infection. Therefore, it is preferable to provide an economical and disposable pillow for use in hospital to protect the patient from infection with other diseases without forming an economic burden to the patient.

SUMMARY OF THE INVENTION

It is therefore a primary object of the present invention to provide a disposable pillow that is made of recyclable pulp and is therefore low in cost and price.

Another object of the present invention is to provide a disposable pulp-molded pillow that is designed for economical use only by one patient during the period in hospital to avoid infection by contacting with a hospital-supplied pillow on which there might still be survived bacteria.

To achieve the above and other objects, the disposable pulp-molded pillow according to the present invention mainly includes an open-bottomed hollow outer body and preferably an inner support having a plurality of upright ridge portions. The outer body has a top surface within which a smoothly curved recess is formed for comfortably supporting a patient's head. The inner support is adapted to be positioned in and below the outer body with upper ends of the ridge portions fitly contacting with and therefore firmly supporting an underside of the top surface of the outer body, preventing the top surface from downward collapsed when a patient's head is supported thereat.

The outer body and the inner support of the pillow of the present invention are dried at high temperature when they are vacuum molded and then pressed with suitable machine to obtain smooth outer surface and dense and strong structure.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
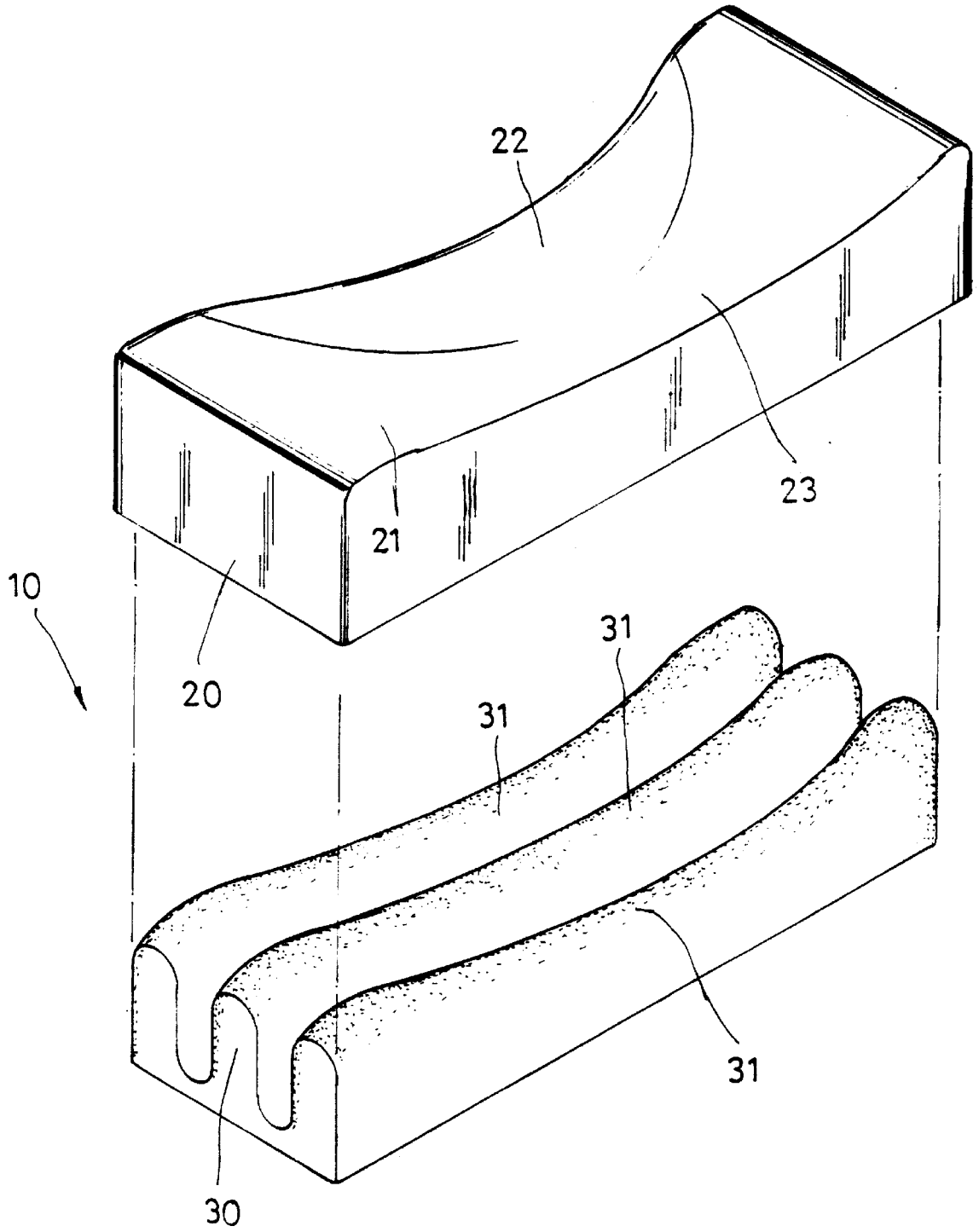
FIG. 1 is an exploded perspective of a disposable pulp-molded pillow according to the present invention.
Figure 2:
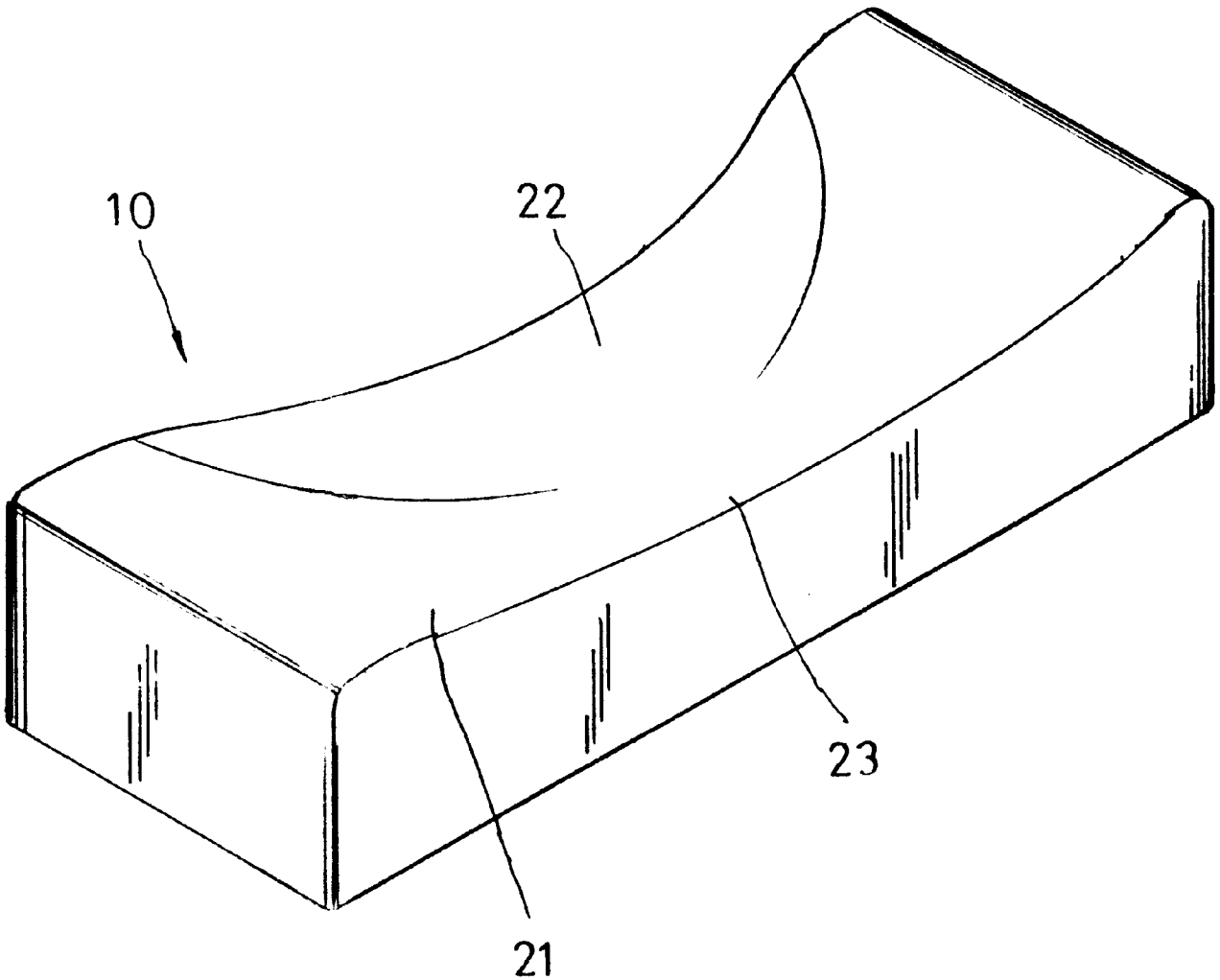
FIG. 2 is an assembled perspective of the disposable pulp-molded pillow of FIG. 1.
Figure 3:
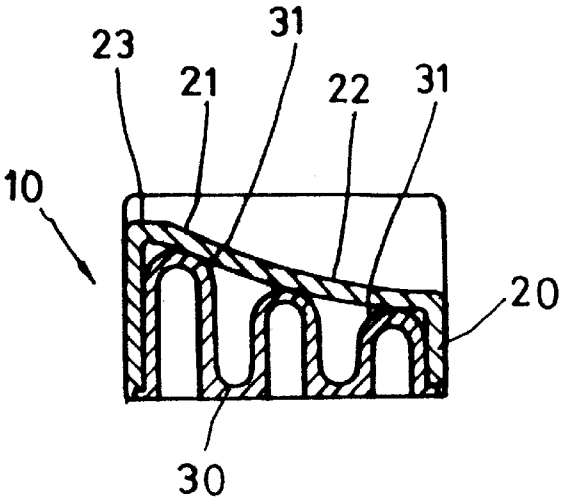
FIG. 3 is a side sectional view of the disposable pulp-molded pillow of FIG. 1.

Please refer to FIGS. 1 and 2 that are exploded and assembled perspective views, respectively, of a disposable pulp-molded pillow 10 according to the present invention. The pillow 10 mainly includes an outer body 20 and preferable an inner support 30, both of which are made of pulp through vacuum molding. The outer body 20 is an open-bottomed hollow member defining a space therein. The outer body 20 includes a top surface 21 and peripheral walls. The top surface 21 of the outer body 20 is formed of a smoothly curved recess 22 adapted to support a patient's head thereat. The inner support 30 includes a plurality of upright ridge portions 31 and is adapted to be stably positioned in and below the outer body 20 with the upright ridge portions 31 upward projected into the space defined by the outer body 20 and fitly contacting their upper ends with an underside of the top surface 21 of the outer body 20, as shown in FIG. 3, so that the top surface 20 of the outer body 20 is supported on the inner support 30 without becoming collapsed under the weight of the patient's head.

As mentioned above, both the outer body 20 and the inner support 30 are made of pulp through vacuum molding. In the process of molding, the primarily shaped outer body 20 and inner support 30 are dried to a predetermined extent under high temperature and then subjected to pressing with suitable machines, so that the outer body 20 and the inner support 30 have smooth outer surface and are dense and thick enough to provide the pillow an enhanced structural strength.

The disposable pulp-molded pillow 10 illustrated in FIG. 1 represents a preferred embodiment of the present invention. In this preferred embodiment, the outer body 20 is substantially in the shape of a rectangle with the recess 22 located at a central area of the top surface 21. A portion of the recess 22 at one side of the outer body 20 closer to the patient's body slightly inclines upward and outward to be higher than other areas of the recess 22 to provide a neck support 23, so that the patient may comfortably support his or her neck on the slightly smoothly raised neck support 23. In practical use of the pillow of the present invention, a suitable pillowcase or towel may be used to cover the top surface 21 of the outer body 20 to make the outer body 20 softer.

Figure 4:
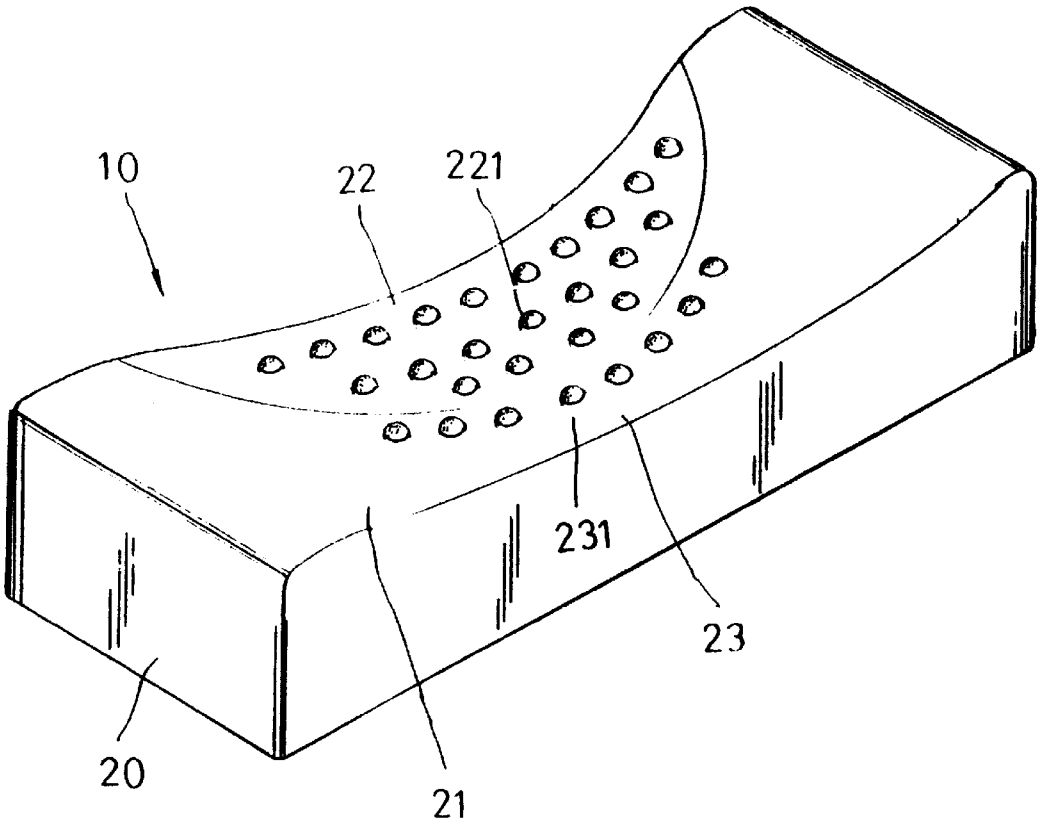
FIG. 4 is a perspective of another embodiment of the disposable pulp-molded pillow of the present invention.

In another embodiment of the present invention shown in FIG. 4, there are a plurality of slightly raised dots 221 and

231 distributed over the recess 22 and the neck support 23, respectively. Such raised dots 221 and 231 lightly press against and massage the patient's head and neck to improve the patient's circulation of blood at these areas. It is natural that such pillow is also useful to all other people in improving their circulation of blood at the head and the neck as well as their sleep quality. The raised dots 221 and 231 may be formed along with the outer body 20 with suitably designed molds.

Since the inner support 30 is designed to support the top surface 21 of the outer body 20, lower edges of the inner support 30 must be lower than or, at least, flush with that of the outer body 20 when the inner support 30 is disposed in and below the outer body 20. However, for integrity of the pillow 10 in its appearance, it is preferable to have an inner support 30 that is completely invisible from outside of the outer body 20, as shown in FIG. 3. Of course, it is also possible to omit the inner support 30 if the outer body 20 itself is structurally strong enough to support the patient's head alone.

When the pillow 10 is dried under high temperature in the process of molding, it is sterilized at the same time. Furthermore, since the pillow 10 is designed for use by only one patient in hospital, the patient can be assured that the disposable pulp-molded pillow 10 he or she uses is absolutely free from any bacteria from any other patients. That is, the pulp-molded pillow 10 is both physiologically and psychologically safe for use. And, since the pulp-molded pillow 10 could be manufactured with recyclable pulp at low cost, it would not form any extra burden to the patient to affect the patient's mood during treatment in hospital.

In brief, the disposable pulp-molded pillow 10 is an economical and practical product for safe use in hospital to reduce possible infection. And, since the pulp-molded pillow 10 is made of a recyclable material, it can be easily disposed after use simply by burning it without causing any pollution to the environment.

What is claimed is:

1. A disposable pulp-molded pillow comprising a substantially rigid outer body and a substantially rigid inner support, both being made of recyclable pulp through vacuum molding; said outer body being an open-bottomed hollow member defining a space therein and including a top surface and peripheral walls, said top surface of said outer body being formed of a smoothly curved recess adapted to support a patient's head thereat, and a portion of said recess slightly inclining upward toward one side of said outer body closer to a patient's body to be higher than other portions of said recess to provide a neck support; and said inner support including a plurality of upright ridge portions and being adapted to be stably positioned in and below said outer body with said upright ridge portions upwardly projected into said space defined by said outer body and fitly contacting their upper ends with an underside of said top surface of said outer body to effectively support said top surface.

2. A disposable pulp-molded pillow as claimed in claim 1, wherein said outer body is provided at said recess of said top surface with a plurality of slightly raised dots.

3. A disposable pulp-molded pillow as claimed in claim 1, wherein said outer body is provided at said neck support of said top surface with a plurality of slightly raised dots.

4. A disposable pulp-molded pillow as claimed in claim 1, wherein said outer body is structurally strong enough due to the firmness thereof to support a patient's head without the need of positioning said inner support in and below said outer body.

* * * * *